US007185700B2

(12) United States Patent
Collins et al.

(10) Patent No.: US 7,185,700 B2
(45) Date of Patent: Mar. 6, 2007

(54) SEPARABLE PLUG FOR USE WITH A WELLBORE TOOL

(75) Inventors: Ronald B. Collins, Edmonton (CA); Wayne Richard Jolly, Ardrossan (CA)

(73) Assignee: Weatherford/Lamb, Inc., Houston, TX (US)

( * ) Notice: Subject to any disclaimer, the term of this patent is extended or adjusted under 35 U.S.C. 154(b) by 278 days.

(21) Appl. No.: 10/867,389

(22) Filed: Jun. 14, 2004

(65) Prior Publication Data

US 2005/0274511 A1 Dec. 15, 2005

(51) Int. Cl.
*E21B 47/01* (2006.01)
*E21B 17/06* (2006.01)

(52) U.S. Cl. ..... 166/254.2; 166/66; 166/242.6

(58) Field of Classification Search ..... 166/254.2, 166/242.7, 242.6, 301, 98, 387, 66, 192, 166/242.2

See application file for complete search history.

(56) References Cited

U.S. PATENT DOCUMENTS

| | | | | |
|---|---|---|---|---|
| 3,550,684 | A * | 12/1970 | Cubberly, Jr. | 166/254.2 |
| 3,559,905 | A | 2/1971 | Palynchuk | |
| 4,064,939 | A * | 12/1977 | Marquis | 166/254.2 |
| 4,349,072 | A * | 9/1982 | Escaron et al. | 166/254.2 |
| 4,457,370 | A | 7/1984 | Wittrisch | |
| 4,460,038 | A | 7/1984 | Clamens | |
| 4,484,628 | A * | 11/1984 | Lanmon, II | 166/254.2 |
| 4,682,657 | A | 7/1987 | Crawford | |
| 4,794,791 | A | 1/1989 | Wittrisch | |
| 5,042,297 | A | 8/1991 | Lessi | |
| 5,080,175 | A | 1/1992 | Williams | |
| 5,172,765 | A | 12/1992 | Sas-Jaworsky et al. | |
| 5,184,682 | A | 2/1993 | Delacour et al. | |
| 5,217,075 | A | 6/1993 | Wittrisch | |
| 5,234,058 | A | 8/1993 | Sas-Jaworsky et al. | |
| 5,348,097 | A | 9/1994 | Giannesini et al. | |
| 5,373,906 | A * | 12/1994 | Braddick | 175/67 |
| 5,505,259 | A | 4/1996 | Wittrisch et al. | |
| 5,608,214 | A | 3/1997 | Baron et al. | |
| 5,636,686 | A | 6/1997 | Wittrisch | |
| 5,749,417 | A | 5/1998 | Delatorre | |
| 6,098,713 | A * | 8/2000 | Ross | 166/297 |
| 6,157,761 | A | 12/2000 | Wittrisch | |
| 6,173,787 | B1 | 1/2001 | Wittrisch | |
| 6,179,058 | B1 | 1/2001 | Wittrisch | |
| 6,575,241 | B2 | 6/2003 | Widney et al. | |
| 2003/0090390 | A1 | 5/2003 | Snider et al. | |

FOREIGN PATENT DOCUMENTS

| | | |
|---|---|---|
| FR | 2 652 160 | 3/1991 |

* cited by examiner

*Primary Examiner*—Kenneth Thompson
(74) *Attorney, Agent, or Firm*—Patterson & Sheridan, LLP

(57) ABSTRACT

The present invention generally relates to a tool for use in a wellbore. In one aspect, a method of performing an operation in a wellbore is provided. The method includes running a selectively separable plug member accommodating a tool into the wellbore on a continuous rod. Next, a first portion of the plug member is separated from a second portion and then the continuous rod is used to position the second portion with the tool below the first portion to perform the operation. In another aspect, a method of logging a wellbore is provided. In yet another aspect, a plug assembly for use in a wellbore is provided.

25 Claims, 4 Drawing Sheets

SEPARABLE PLUG FOR USE WITH A WELLBORE TOOL

BACKGROUND OF THE INVENTION

1. Field of the Invention

The present invention generally relates to the operation of instrumentation within a wellbore. More particularly, the invention relates to a separable plug for use with a wellbore tool.

2. Description of the Related Art

In the drilling of oil and gas wells, a wellbore is formed using a drill bit that is urged downwardly at a lower end of a drill string. After drilling a predetermined depth, the drill string and the drill bit are removed, and the wellbore is lined with a string of steel pipe called casing. The casing provides support to the wellbore and facilitates the isolation of certain areas of the wellbore adjacent hydrocarbon bearing formations. An annular area is thus defined between the outside of the casing and the earth formation. This annular area is typically filled with cement to permanently set the casing in the wellbore and to facilitate the isolation of production zones and fluids at different depths within the wellbore. Numerous operations occur in the well after the casing is secured in the wellbore. All operations require the insertion of some type of instrumentation or hardware within the wellbore. For instance, wireline logging tools are employed in the wellbore to determine various formation parameters including hydrocarbon saturation.

Early oil and gas wells were typically drilled in a vertical or near vertical direction with respect to the surface of the earth. As drilling technology improved and as economic and environmental demands required, an increasing number of wells were drilled at angles which deviated significantly from vertical. In the last several years, drilling horizontally within producing zones became popular as a means of increasing production by increasing the effective wellbore wall surface exposed to the producing formation. It was not uncommon to drill sections of wellbores horizontally (i.e. parallel to the surface of the earth) or even "up-hill" where sections of the wellbore were actually drilled toward the surface of the earth.

The advent of severely deviated wellbores introduced several problems in the performance of some wellbore operations. Conventional wireline logging was especially impacted. Wireline logging utilizes the force or gravity to convey logging instrumentation into a wellbore. Gravity is not a suitable conveyance force in highly deviated, horizontal or up-hill sections of wellbores. Numerous methods have been used, with only limited success, to convey conventional wireline instrumentation or "tools" in highly deviated conditions. These methods include conveyance using a drill string, a coiled tubing, and a hydraulic tractor. All methods require extensive well site equipment, and often present operational, economic, and logistic problems.

Another problem that affects both a deviated wellbore and a vertical wellbore occurs when the wellbore contains a high percentage of water relative to the hydrocarbons in the surrounding formations. In this situation, fluid tends to collect and remain static proximate the lowest point of the wellbore because there is not enough hydrocarbon formation pressure to move the fluid. For instance, fluid tends to collect at the junction between the vertical portion and the deviated portion in a deviated wellbore. Without fluid flow, production logging tools can not operate properly to collect data. To overcome this problem, some form of artificial lift is typically employed to move fluids through the wellbore, such as a submersible pump. The increased velocity of the fluid provides an adequate flow rate for the logging tool to operate.

Generally, the submersible pump is run into the wellbore on production tubing with a Y block between the production tubing and the submersible pump. The Y block allows the pump to be turned on and the well produced while leaving an access point to the wellbore for logging tools. Typically, the access point is a smaller string of tubing attached to the Y block which is run along side the submersible pump. In operation, a logging tool is conveyed through the production tubing attached to a string of coiled tubing. As the logging tool passes through the Y block and the smaller string of tubing, a plug attached to the string of coiled tubing lands in a seat formed in the smaller string of tubing. The plug seals off the smaller string of tubing while allowing the string of coiled tubing and the logging tool to continue to travel into the wellbore. Although coiled tubing may be used in deviated wellbores, the coiled tubing and associated injector equipment are still physically large and present drawbacks similar to those encountered with drill string conveyed systems.

A need therefore exists for a reliable and operationally efficient system to convey and operate wellbore tools, like logging tools, in wellbores which are deviated from the vertical.

SUMMARY OF THE INVENTION

The present invention generally relates to a tool for use in a wellbore. In one aspect, a method of performing an operation in a wellbore is provided. The method includes running a selectively separable plug member accommodating a tool into the wellbore on a continuous rod. Next, a first portion of the plug member is separated from a second portion and then the continuous rod is used to position the second portion with the tool below the first portion to perform the operation.

In another aspect, a method of logging a wellbore is provided. The method includes running a selectively actuatable plug member into the wellbore on a continuous rod, wherein the plug member accommodates a logging tool. Next the plug member is actuated, thereby separating a first portion of the plug member from a second portion. Thereafter, the continuous rod is used to run the second portion with the logging tool to a predetermined location below the first portion to collect data.

In yet another aspect, a plug assembly for use in a wellbore is provided. The plug assembly includes a first portion with a pressure activatable ring member for sealing around a continuous rod. The plug assembly further includes a second portion for accommodating a wellbore tool. Additionally, the plug assembly includes a releaseable member disposed between the first portion and the second portion to selectively allow the second portion to separate from the first portion while the first portion maintains a sealing relationship with the continuous rod.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In general, the present invention relates to a selectively actuated logging plug for use with a continuous rod, such as a COROD string. The COROD string is a means and a method for conveying and operating a wide variety of equipment within a wellbore. The COROD string works equally well in vertical and highly deviated wells. When the COROD string is used in logging operations, the downhole tools record data of interest in memory within the downhole tool rather than telemetering the data to the surface as in conventional wireline logging. Data is subsequently retrieved from memory when the tool is withdrawn from the wellbore. The tool position in the wellbore is synchronized with a depth encoder, which is preferably at the surface near a COROD injector apparatus. The depth encoder measures the amount of COROD string within the well at any given time. Data measured and recorded by the downhole tool is then correlated with the depth encoder reading thereby defining the position of the tool in the well. This information is then used to form a "log" of measured data as a function of depth within the well at which the data is recorded. The COROD can be used for multiple runs into a well with no fatigue as compared to coiled tubing operations. COROD can be run through tubing thereby eliminating the additional cost and time required to deploy a drill string, coiled tubing, or tractor conveyed systems. It is also noted that the COROD string for conveying equipment is not limited to oil and gas well applications. The system is equally applicable to pipeline where pipeline inspection services are run. To better understand the novelty of the apparatus of the present invention and the methods of use thereof, reference is hereafter made to the accompanying drawings.

Figure 1:
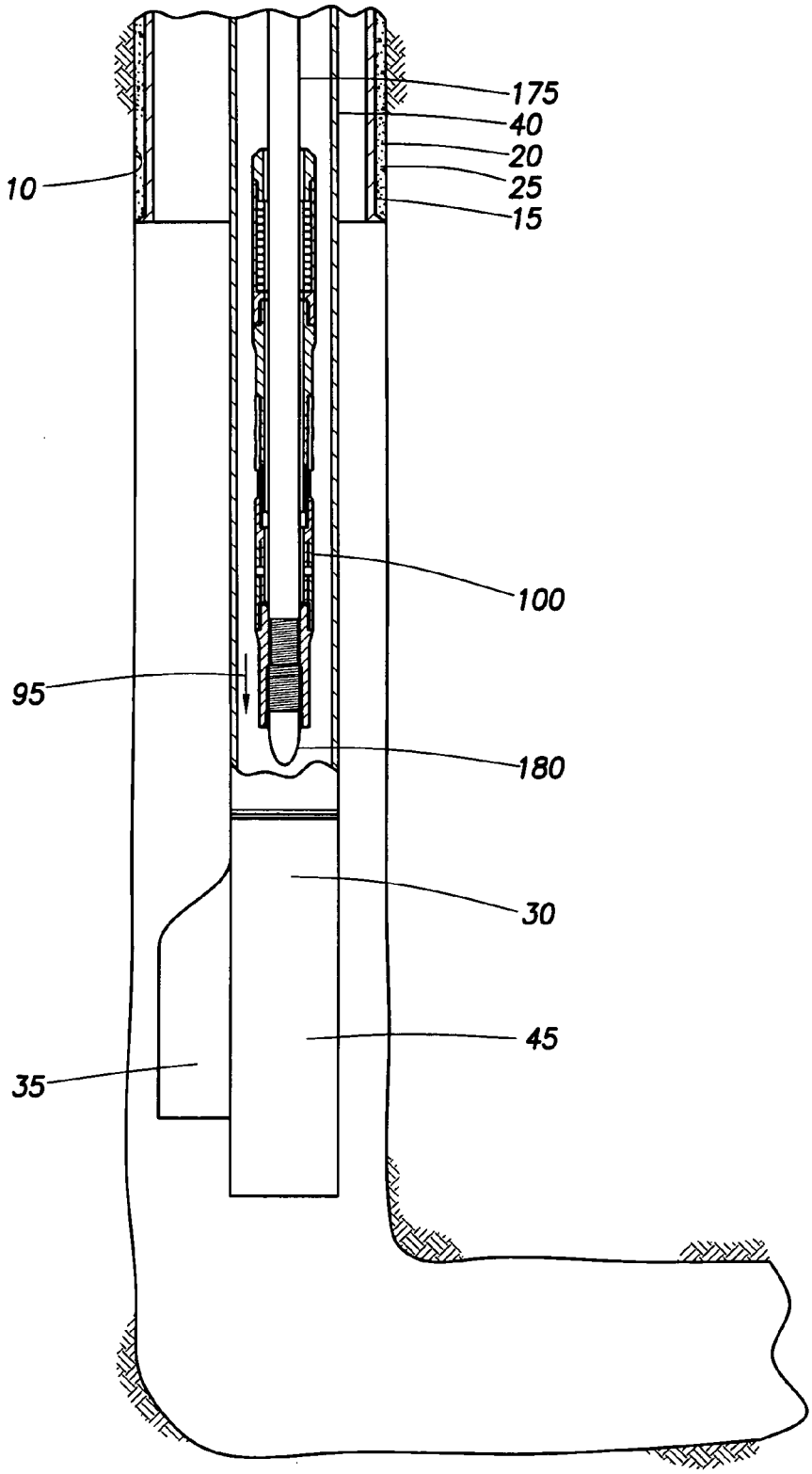
FIG. 1 is a sectional view illustrating a tool and a plug assembly being lowered into a wellbore on a continuous rod.

FIG. 1 is a sectional view illustrating a tool 180 and a plug assembly 100 being lowered into a deviated wellbore 10 on a continuous string, such as a COROD string 175. For purposes of discussion, the wellbore 10 is illustrated as a deviated wellbore. It should be understood, however, that the plug assembly 100 may be employed in a vertical wellbore, without departing from principles of the present invention.

As illustrated, the wellbore 10 is lined with a string of steel pipe called casing 15. The casing 15 provides support to the wellbore 10 and facilitates the isolation of certain areas of the wellbore 10 adjacent hydrocarbon bearing formations. The casing 15 typically extends down the wellbore 10 from the surface of the well to a designated depth. An annular area 20 is thus defined between the outside of the casing 15 and the wellbore 10. This annular area 20 is filled with cement 25 pumped through a cementing system (not shown) to permanently set the casing 15 in the wellbore 10 and to facilitate the isolation of production zones and fluids at different depths within the wellbore 10. Subsequently, a submersible pump 35 is run into the wellbore 10 on a production tubing 40 with a Y-block 30 between the production tubing 40 and the submersible pump 35. The Y block 30 allows the pump 35 to be turned on and the well produced while leaving an access point to the wellbore 10 for logging tools. Typically the access point is an instrument tube 45 positioned adjacent the submersible pump 35 and attached to the Y block 30.

After the submersible pump 35 and the production tubing 40 are positioned in the wellbore 10, the plug assembly 100 and the tool 180 are lowered through the production tubing 40 on the COROD string 175 in the direction indicated by arrow 95. Generally, the COROD string 175 is lowered into the wellbore 10 by an injector apparatus (not shown). The injector apparatus typically includes a depth encoder (not shown) to record the amount of COROD string 175 within the wellbore 10 at any given time thereby determining the position of the tool 180 within the wellbore 10. Additionally, the depth encoder may be used to determine the location of the plug assembly 100 in relation to the instrument tube 45 as the plug assembly 100 is lowered through the production tubing 40.

Figure 2:
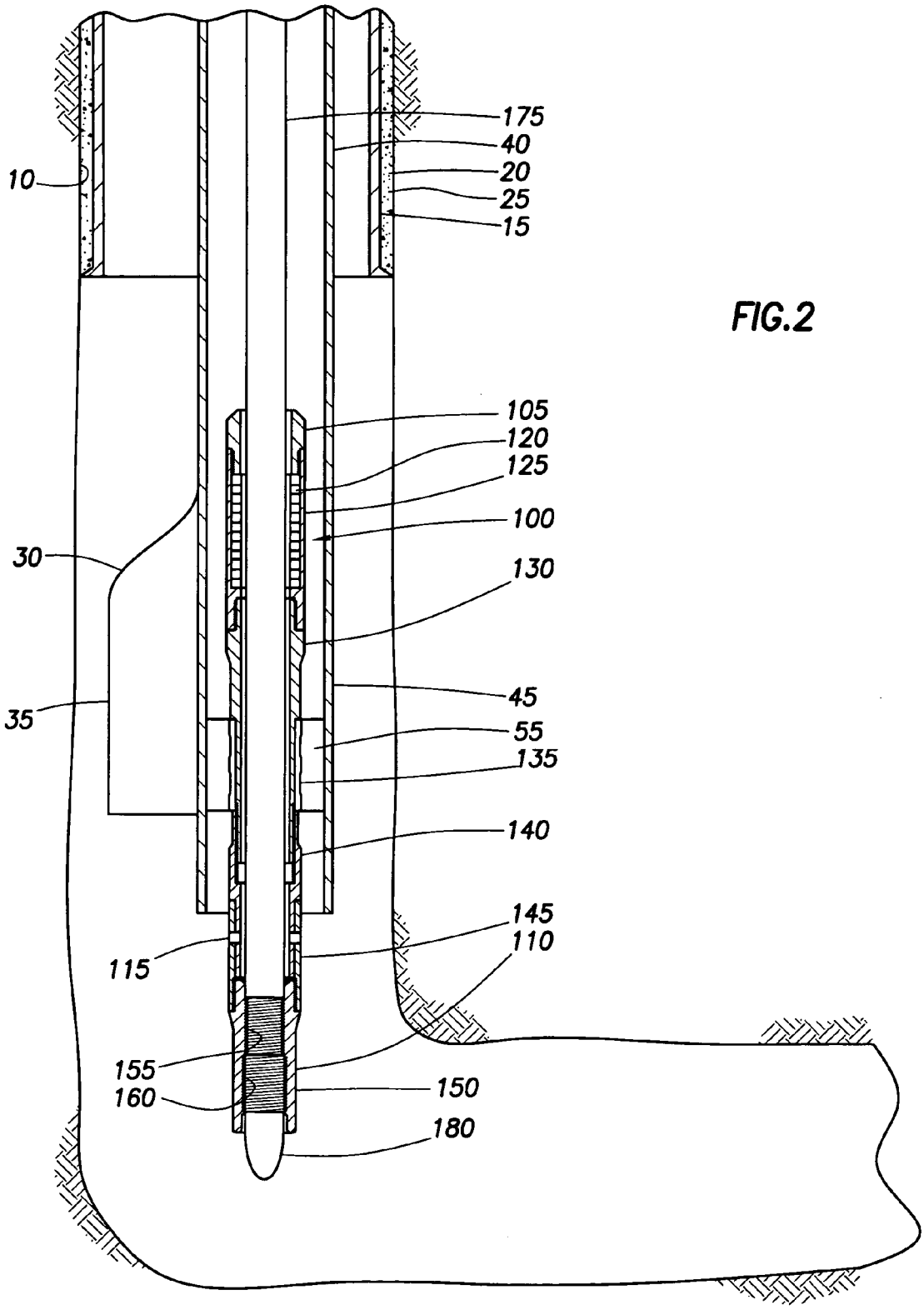
FIG. 2 is a sectional view illustrating the plug assembly being positioned in a receiver member.

FIG. 2 is a sectional view illustrating the plug assembly 100 being positioned in a receiver member 55. The plug assembly 100 generally comprises a first portion 105 and a second portion 110. The first and second portions 105, 110 are operatively attached to each other by a selectively actuated release member 115. The release member 115 is a device that operates at a predetermined pressure or force. In one embodiment, the release member 115 is a shear bolt or shear pin disposed between the first portion 105 and the second portion 110 as illustrated in FIG. 2. The shear bolt is constructed and arranged to fail at a predetermined axial force. Generally, the shear bolt is a short piece of brass or steel that is used to retain sliding components in a fixed position until sufficient force is applied to break the bolt. Once the bolt is sheared, the components may then move to operate the tool.

Alternatively, other forms of shearable members may be employed in the release member 115, as long as they are capable of shearing at a predetermined force. For example, a threaded connection (not shown) may be employed between the first portion 105 and the second portion 110. Generally, the threads machined on the first portion 105 are mated with threads machined on the second portion 110 to form the threaded connection. The threads on the first portion 105 and the second portion 110 are machined to a close fit tolerance. The threads are constructed and arranged to fail or shear when a predetermined axial force is applied to the plug assembly 100. The desired axial force required to actuate the release member 115 determines the quantity of threads and the thread pitch.

The first portion 105 includes a pressure activated ring 120 substantially enclosed in a housing 125 at an upper end thereof. The pressure activated ring 120 creates and maintains a seal around the COROD string 175 during deployment of tool 180. The ring 120 is pressure activated, whereupon the application of a predetermined pressure in the production tubing 40 a sealing relationship is formed between the plug assembly 100 and the COROD string 175. In one embodiment, the ring 120 is constructed from an elastomeric material.

Adjacent the housing 125 is an upper mandrel 130 with a ring member 135 disposed around the outer surface thereof. The ring member 135 secures and seals the first portion 105 within the instrument tube 45. The ring member 135 includes a plurality of profiles formed on the outer surface thereof that mate with a receiver member 55 formed in the instrument tube 45. After the ring member 135 mates with the receiver member 55, a sealing relationship is formed between the plug assembly 100 and the instrument tube 45. If there is no sealing relationship between the plug assembly 100 and the instrument tube 45, the pump 35 will only circulate fluid around the Y-block 30 rather than pumping fluid up the production tubing 40. In one embodiment, the ring member 135 is constructed from a fiber material.

The first portion 105 further includes a lower mandrel 140 attached to the upper mandrel 130 through a connection member, such as a lock nut assembly. Additionally, the lower mandrel 140 is operatively attached to a housing 145, on the second portion 110 by the selectively actuated release member 115.

Adjacent the housing 145 in the second portion 110 is a connector 150. The connector 150 includes a first threaded portion that mates with a threaded portion on the COROD string 175 to form a threaded connection 155 which connects the plug assembly 100 to the COROD string 175. The connector 150 includes a second threaded portion that mates with a threaded portion on the tool 180 to form a threaded connection 160 which connects the plug assembly 100 to the tool 180. It should be understood, however, that COROD string 175 and the tool 180 may be connected to the plug assembly 100 by any type of connection member, without departing from principles of the present invention.

As illustrated in FIG. 2, the plug assembly 100 is urged through the production tubing 40 and the Y-block 30 into instrument tube 45 until the ring member 135 contacts the receiver member 55 formed in the instrument tube 45. At that point, the ring member 135 mates with the receiver member 55 to form a seal between the plug assembly 100 and the instrument tube 45. As the COROD string 175 continues to be urged downward, a force is created on the release member 115. At a predetermined force, the release member 115 actuates, thereby allowing the second portion 110 of the plug assembly 100 and the tool 180 to move in relation to the first portion 105 of the plug assembly 100 which is secured in the instrument tube 45.

Figure 3:
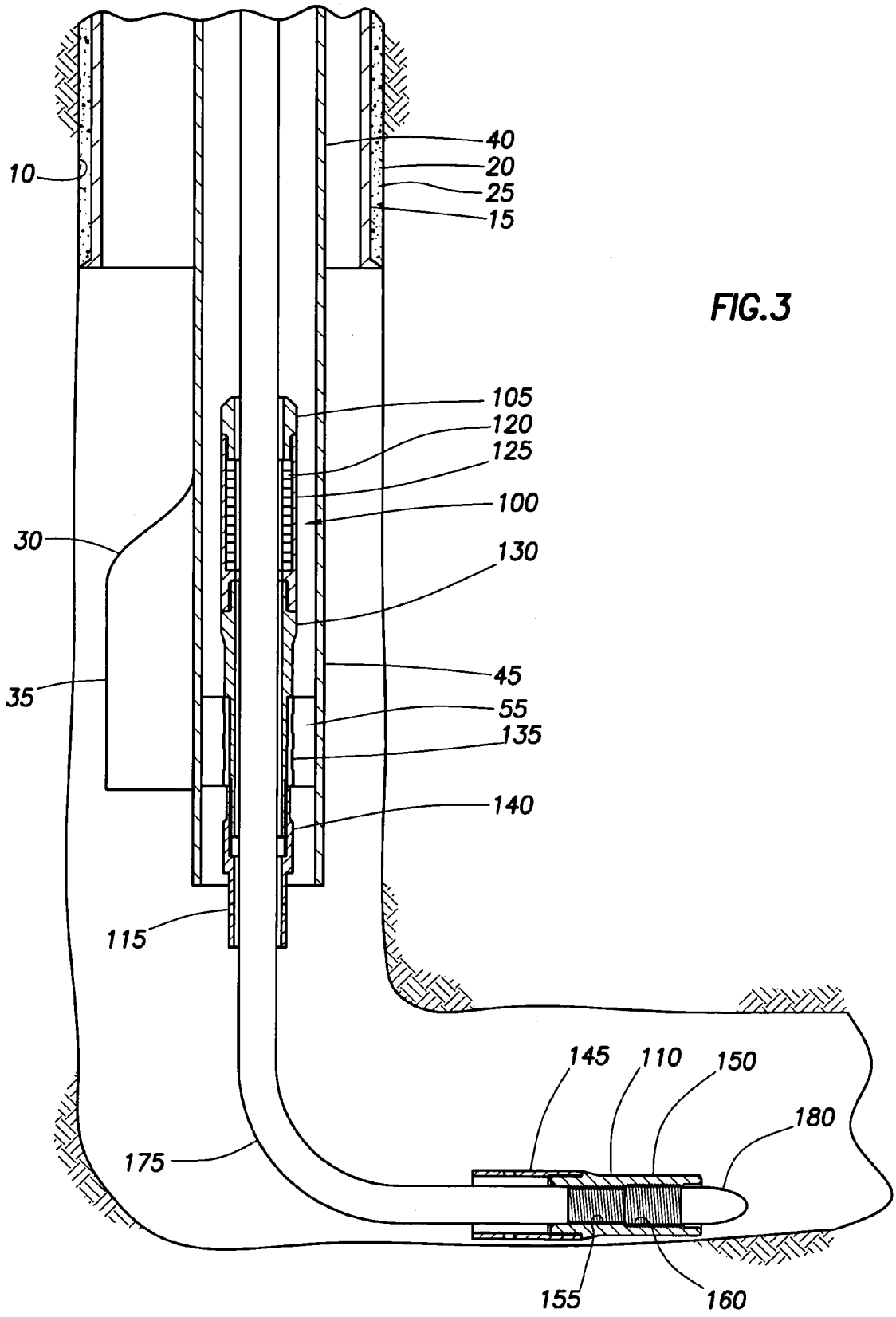
FIG. 3 is a sectional view illustrating the tool being urged through the wellbore after the plug assembly has been actuated.

FIG. 3 is a sectional view illustrating the tool 180 being urged through the wellbore 10 after the plug assembly 100 has been actuated. For purposes of discussion, assume the tool 180 is a logging tool. It is to be understood, however, that the tool 180 may be any type of wellbore tool without departing from principles of the present invention, such as a casing perforating "gun" for perforating the casing 15 in a formation zone of interest. The tool 180 may also be a casing inspection tool, or a production logging tool to measure the amount and type of fluid flowing within the casing 15 or within production tubing 40. The tool 180 can also be a fishing tool that is used to retrieve unwanted hardware from the wellbore 10, such as an overshot or a spear. It should be further noted that the tool 180 need not be retrieved when the COROD string 175 is withdrawn from the wellbore 10. As an example, the tool 180 could be a packer or a plug, which is left positioned within the borehole when the COROD string 175 is withdrawn. Thus, the COROD string 175 is suitable for delivering or operating completions tools.

As shown in FIG. 3, the COROD string 175 continues to urge the second portion 110 along with the tool 180 through the deviated portion of the wellbore 10 to conduct a logging operation. At the same time, the pressure activated ring 120 maintains a seal around the COROD string 175 and the ring member 135 maintains a seal between the plug assembly 100 and the instrument tube 45.

In one embodiment, the tool 180 contains a sensor package (not shown) which responds to formation and wellbore parameters of interest. The sensors can be nuclear, acoustic, electromagnetic, or combinations thereof. Response data from the sensor package is recorded in a memory member (not shown) for subsequent retrieval and processing when the tool 180 is withdrawn from the wellbore 10. A power supply (not shown), which is typically a battery pack, provides operational power for the sensor package and memory member. As the data is retrieved from the memory, it is correlated with the depth encoder response to form a "log" of measured parameters of interest as a function of depth within the wellbore 10.

In another embodiment, the invention is equally usable with more traditional wireline logging methods dependent upon a conductor to transmit data as logging operations are taking place. The COROD string 175 can be manufactured with a longitudinal bore therethrough to house a conductor (not shown) suitable for transmitting data. In one example, the conductor is placed within the bore of the COROD string 175 prior to rolling the COROD string 175 on a transportation reel (not shown). As the tool 180 and the plug assembly 100 are assembled at one end of the COROD string 175, a mechanical and electrical connection is made between the conductor housed in the COROD string 175 and the tool 180 connected to the end of the COROD string 175 prior to insertion into the wellbore 10. In this manner, the COROD string 175 is used to both carry the tool 180 downhole and transmit data from the tool 180 to the surface of the wellbore 10.

In another embodiment, the COROD string 175 itself can act as a conductor to transmit data to the surface of a wellbore 10. For example, COROD string 175 can be covered with a coating of material (not shown) having the appropriate conductive characteristics to adequately transmit signals from the tool 180. In this manner, no additional conductor is necessary to utilize the tool 180 placed at the end of the COROD string 175.

Additionally, the COROD string 175 can be used to transport logging tools (not shown) that are capable of real time communication with the surface of the well without the use of a conductor. For example, using a telemetry tool and gamma ray tool disposed on the COROD string 175 having various other remotely actuatable tools disposed thereupon, the location of the tools with respect to wellbore zones of interest can be constantly monitored as the telemetry tool transmits real time information to a surface unit. At the surface, the signals are received by signal processing circuits in surface equipment (not shown), which may be of any suitable known construction for encoding and decoding, multiplexing and demultiplexing, amplifying and otherwise processing the signals for transmission to and reception by the surface equipment. The operation of the gamma ray tool is controlled by signals sent downhole from surface equipment. These signals are received by a tool programmer which transmits control signals to the detector and a pulse height analyzer.

The surface equipment includes various electronic circuits used to process the data received from the downhole equipment, analyze the energy spectrum of the detected gamma radiation, extract therefrom information about the formation and any hydrocarbons that it may contain, and produce a tangible record or log of some or all of this data and information, for example on film, paper or tape. These circuits may comprise special purpose hardware or alternatively a general purpose computer appropriately programmed to perform the same tasks as such hardware. The data/information may also be displayed on a monitor and/or saved in a storage medium, such as disk or a cassette.

The electromagnetic telemetry tool generally includes a pressure and temperature sensor, a power amplifier, a downlink receiver, a central processing unit, and a battery unit. The electromagnetic telemetry tool is selectively controlled by signals from the surface unit to operate in a pressure and temperature sensing mode, providing for a record of pressure versus time or a gamma ray mode which records gamma counts as the apparatus is raised or lowered past a correlative formation marker. The record of gamma counts is then transmitted to surface and merged with the surface system depth/time management software to produce a gamma ray mini log which is later compared to the wireline open-hole gamma ray log to evaluate the exact apparatus position. In this manner, components, including packers and bridge plugs can be remotely located and actuated in a wellbore using real time information that is relied upon solely or that is compared to a previously performed well log.

Figure 4:
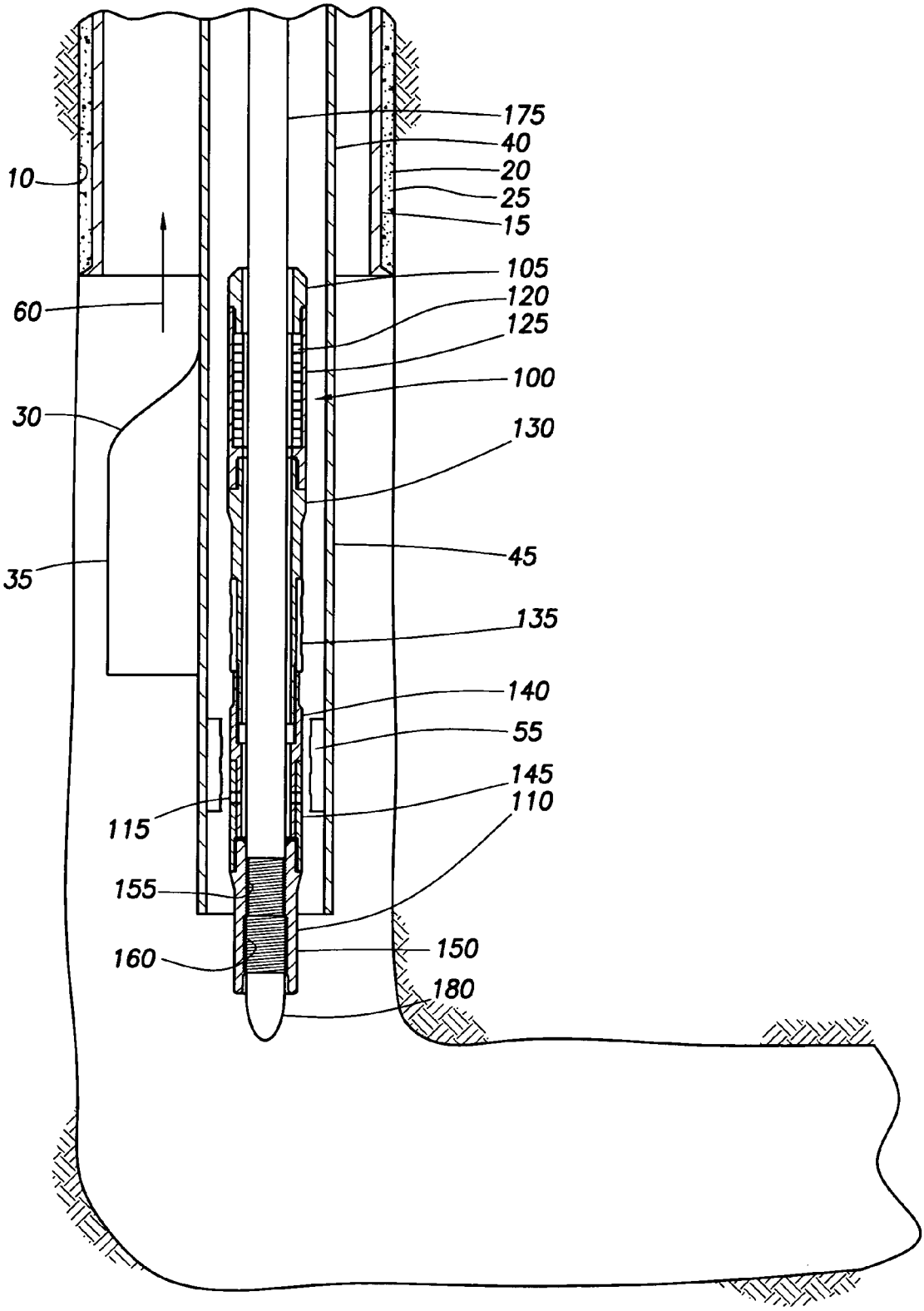
FIG. 4 is a sectional view illustrating the tool and the plug assembly being removed from the wellbore.

FIG. 4 is a sectional view illustrating the tool 180 and the plug assembly 100 being removed from the wellbore 10. After the logging operation is complete, the COROD string 175, tool 180 and second portion 110 are urged toward the surface of the wellbore 10 until the second portion 110 of the plug assembly 100 contacts the first portion 105. At that time, the housing 145 of the second portion 110 aligns with the lower mandrel 140 of the first portion 105. Thereafter, the plug assembly 100 comprised of the first and the second portions 105, 110 acts as one unit. As the COROD string 175 continues to be urged toward the surface of the wellbore 10, the ring member 135 disengages from the receiver member 55, thereby removing the sealing relationship between the plug assembly 100 and the instrument tube 45. Subsequently, the plug assembly 100, the tool 180 and COROD string 175 are pulled out of the wellbore 10 in the direction indicated by arrow 60. At the surface of the wellbore 10, the ring member 135 may be replaced and the plug assembly 100 may be once again transported into the wellbore 10 with another logging tool at the lower end of a COROD string.

In operation, a logging tool and a plug assembly are urged though a production tubing into a deviated wellbore on a COROD string. Generally, the plug assembly comprises a first portion and a second portion operatively connected to each other by a selectively activated release member. The logging tool and plug assembly are urged through the production tubing until the first portion of the plug assembly seats in the receiver member formed in an instrument tube at the lower end of the production tubing. As the COROD string continues to be urged downward, a force is created on the selectively activated release member. At a predetermined force, the release member is activated, thereby allowing the second portion of the plug assembly and the logging tool to move in relation to the first portion of the plug assembly which is secured in the instrument tube. Thereafter, the COROD string continues to urge the second portion along with the logging tool through the deviated portion of the wellbore to conduct a logging operation. After the logging operation is complete, the COROD string urges the logging tool and second portion toward the surface of the wellbore until the second portion of the plug assembly contacts and aligns with the first portion. Thereafter, the plug assembly comprised of the first and the second portions acts as one unit. Subsequently, the plug assembly, the logging tool and COROD string are pulled out of the wellbore.

While the foregoing is directed to embodiments of the present invention, other and further embodiments of the invention may be devised without departing from the basic scope thereof, and the scope thereof is determined by the claims that follow.

The invention claimed is:

1. A method of performing an operation in a wellbore, comprising:

running a selectively separable plug member accommodating a tool on a continuous rod into a tubular disposed in the wellbore;

locating the selectively separable plug member in a receiver member formed in the tubular;

separating a first portion of the plug member from a second portion; and using the continuous rod to position the second portion with the tool below the first portion to perform the operation.

2. The method of claim 1, further including applying an axial force to the plug member to separate the plug member.

3. The method of claim 1, wherein the second portion and the tool are positioned in a deviated portion of the wellbore.

4. The method of claim 1, wherein the tool is a logging tool for use with in a logging operation.

5. The method of claim 1, further including forming a pressure activated sealing relationship between the plug member and the continuous rod.

6. The method of claim 1, wherein using the continuous rod comprises pushing the continuous rod from a surface of the wellbore.

7. The method of claim 1, wherein the first portion maintains a pressurized seal with the continuous rod as the second portion is positioned below the first portion.

8. The method of claim 1, wherein the first portion is operatively attached to the second portion by a selectively activated release member.

9. The method of claim 8, wherein the selectively activated release member comprises a shear pin.

10. The method of claim 9, wherein a predetermined axial force causes the shear pin to fail allowing the sections to separate.

11. A method of logging a wellbore, comprising:

running a selectively actuatable plug member into the wellbore on a continuous rod, wherein the plug member accommodates at least one logging tool;

actuating the plug member, thereby separating a first portion of the plug member from a second portion; and using the continuous rod to run the second portion with the at least one logging tool to a predetermined location below the first portion to collect data.

12. The method of claim 11, further including forming a sealing relationship between a tubular and the first portion of the plug member.

13. The method of claim 11, further including applying an axial force to the plug member to separate the first portion from the second portion.

14. The method of claim 11, further including forming a pressure activated sealing relationship between the plug member and the continuous rod.

15. The method of claim 11, wherein using the continuous rod comprises pushing the continuous rod from a surface of the wellbore.

16. The method of claim 11, further including transmitting data from the logging tool to a surface of the wellbore along the continuous rod.

17. The method of claim 11, further including positioning the first portion of the plug member in a receiver member formed in a tubular predisposed in the wellbore.

18. The method of claim 11, further including operatively connecting the second portion back to first portion.

19. The method of claim 18, further including removing the plug member from the wellbore.

20. A plug assembly for use in a wellbore, comprising:

a first portion with a pressure activatable ring member for sealing around a continuous rod;

a second portion for accommodating at least one wellbore tool; and a releaseable member disposed between the first portion and the second portion to selectively allow the second portion to separate from the first portion while the first portion maintains a sealing relationship with the continuous rod.

21. The plug member of claim 20, wherein the releaseable member comprises a shear pin.

22. The plug member of claim 20, wherein the wellbore tool is a logging tool.

23. The plug member of claim 20, wherein the pressure activatable ring comprises a ring member for creating a sealing engagement with a receiver member of a predisposed wellbore tubular therearound.

24. The plug member of claim 20, wherein the second portion is operatively connected to the continuous rod.

25. The plug member of claim 24, wherein the releaseable member comprises a shearable connection.

* * * * *